US006349419B1

(12) United States Patent
Chiang

(10) Patent No.: US 6,349,419 B1
(45) Date of Patent: Feb. 26, 2002

(54) SWIMMING GOGGLES

(76) Inventor: Herman Chiang, 11F-2, No. 634-9 Ching-Ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 09/687,950

(22) Filed: Oct. 13, 2000

(51) Int. Cl.[7] ..... A61F 9/02
(52) U.S. Cl. ..... 2/428; 2/452; 351/43
(58) Field of Search ..... 2/428, 430, 440, 2/441, 443, 452; 351/43

(56) References Cited

U.S. PATENT DOCUMENTS 5,479,917 A * 1/1996 Hsieh ..... 128/200.29
5,819,321 A * 10/1998 Wang ..... 2/428
5,915,540 A * 6/1999 Chou ..... 2/428
6,098,206 A * 8/2000 Chou ..... 2/428

* cited by examiner

*Primary Examiner*—John J. Calvert
*Assistant Examiner*—Katherine Moran

(74) *Attorney, Agent, or Firm*—Pro-Techtor International Services

(57) ABSTRACT

This invention relates to a type of swimming goggles, comprising: a lens frame main unit, a protective pad, lenses and a headband device, characterized in that: the lens and the protective pad of the swimming goggles are assembled as one unit by compression to the lens frame main unit, wherein the lens frame main unit comprises a frame unit with a center connector at its center part, embedding grooves on the inside rims of the frame unit, and compressing devices on the sides of the frame units, and, the protective pad has a face contact part and a lens accommodating part, wherein the face contact part is for close contact with areas above the eyebrows and below the lower eye sockets of the user, the two eye frames are encompassed in the same one space, while the lens accommodating part accommodating the lenses is assembled in the embedding grooves of the lens frame main unit. The compressing device firmly fasten the lenses and the protective pad, providing the swimming goggles with the performance of a face mask, which enables resistance to water, freedom from uncomfortable pressing on the user's eyeballs, and a broad field of vision.

20 Claims, 7 Drawing Sheets

SWIMMING GOGGLES

BACKGROUND OF INVENTION

1. Field of the invention

This invention relates to a type of swimming goggles, particularly to an innovated construction of swimming goggles which protective pad can encompass two eye frames in a same space to provide wearing comfort and a wider field of vision.

2. Background of invention

Despite the variety of different construction of conventional swimming goggles, the two lens frames cover the two eye sockets separately on the left and right. In other words, conventional design of swimming goggles is aimed at covering the eye sockets to achieve the purpose of resistance to water seepage. Therefore, the protective pads on the lens frames are independently, whether of sponge type or sucker type, are independently assembled on the left and right. When the conventional swimming goggles are worn on the user's face, the protective pad frames covering the rims of eye sockets will have a suction force that will cause discomfort after they are worn for an extended period of time, especially when the user has dived a certain depth underwater. Furthermore, the field of vision of conventional swimming goggles is limited because of the small area of lenses.

Of course, the most direct remedy to overcome the problem of limited field of vision for conventional swimming goggles is to enlarge the lens frames. After the lens frames are enlarged, however, the integral construction of the swimming goggles is also changed, which brings a new issue to ensure best wearing comfort.

OBJECTIVES OF THE INVENTION

The main objective of this invention is to provide a type of swimming goggles that is comfortable to wear and has a wide field of vision; the protective pad of the swimming goggles has the performance of a facemask that covers the areas beyond the eye sockets, and by encompassing the two eyes in the same space, there will be no risk of any pressure on the eyeballs.

CHARACTERISTICS OF THE INVENTION

The main characteristic of this invention of swimming goggles lies in that: the lenses and protective pad of the swimming goggles are compressed and fixed as one unit by the lens frame main unit, wherein the lens frame main unit comprises a center connector that joins the upper and lower rims of the lens frame main unit, embedding grooves that accommodate the lenses and protective pad, and compressing devices located on the sides of the embedding grooves, the compressing device comprising: connecting plates extending from the lens frame main unit, openings penetrating the embedding grooves and connecting plates, and a bottom cover and top cover that join the connecting plates, wherein between the bottom cover, the top cover and the connecting plates are fastening units, and the bottom cover and the top cover have a clasp member to close and engage the embedding grooves to the openings of the connecting plates;

Therefore, the lens and the protective pad can be securely assembled inside the embedding grooves of the lens frame main unit by the fastening unit between the bottom cover, the top cover and the connecting plates, and the clasp member of the bottom cover and the top cover.

Based on the above characteristic, wherein the connecting plate is an extension of the entire side of the lens frame main unit, while the opening divides the connecting plate into two areas, one large and the other small, to facilitate clasping by the clasp member between the bottom cover and the top cover. The fastening unit has fastening holes on the large area connecting plate, and fastening posts at the corresponding positions on the bottom cover, thereby to join the bottom cover with to the connecting plate.

The clasp member has pressing margin on the bottom cover opposite the upper and lower rims of the large area and small area connecting plates. The vertical distance of the pressing margin is equivalent to the closing distance of the large area and small area connecting plates. So, when the fastening post of the bottom cover is inserted in the fastening hole of the large area of the connecting plate, the pressing margin can compress the small area connecting plate to the large area connecting plate, to close the openings of the two parts and achieve the fastening performance by compression. The top cover has a pressing margin at a position opposite the pressing margin of the bottom cover, and between the pressing margin and the compressing margin are depressed grooves and protruded mounds that can be fastened to each other, to further compress the large area and small area connecting plates, and simultaneously, to fix the bottom cover and the top cover.

Another characteristic of this invention of swimming goggles is that, on opposite positions on the bottom cover and the connecting plates are inserting holes to accommodate the insertion of the headband of the swimming goggles.

Another characteristic of this invention of swimming goggles is that, on the inside of the top cover is a stop face to restrict that headband from excessive insertion, and to guide the insertion of the headband.

BRIEF DESCRIPTION OF DRAWINGS

The drawings of preferred embodiments of this invention are described in details as follows to enable better understanding.

BRIEF DESCRIPTION OF NUMERALS

| | | | |
|---|---|---|---|
| 1, 1' | swimming goggles | | |
| 2, 2' | lens frame main unit | | |
| 20, 20' | center connector | 201 | embedding groove |
| 3, 3' | protective pad | | |
| 30 | face contact part | 31 | lens accommodating unit |
| 310 | depressed ring | | |
| 4, 4' | lens | | |
| 5, 5' | compressing device | | |
| 50 | connecting plate | 51 | opening |
| 52 | top cover | 53 | bottom cover |
| 501 | large area connecting plate | 502 | small area connecting plate |

-continued

| BRIEF DESCRIPTION OF NUMERALS | | | |
|---|---|---|---|
| 6, 6' | headband device | 60 | headband |
| 7' | joining face | | |
| 8 | fastening unit | | |
| 80 | fastening hole | 81 | fastening post |
| 9 | clasp member | | |
| 90 | pressing margin | 91 | compressing margin |
| 92 | depressed groove | 93 | protruded mound |
| 94 | inserting hole | 95 | stop face |

DETAILED DESCRIPTION OF PREFERRED EMBODIMENTS

Figure 1:
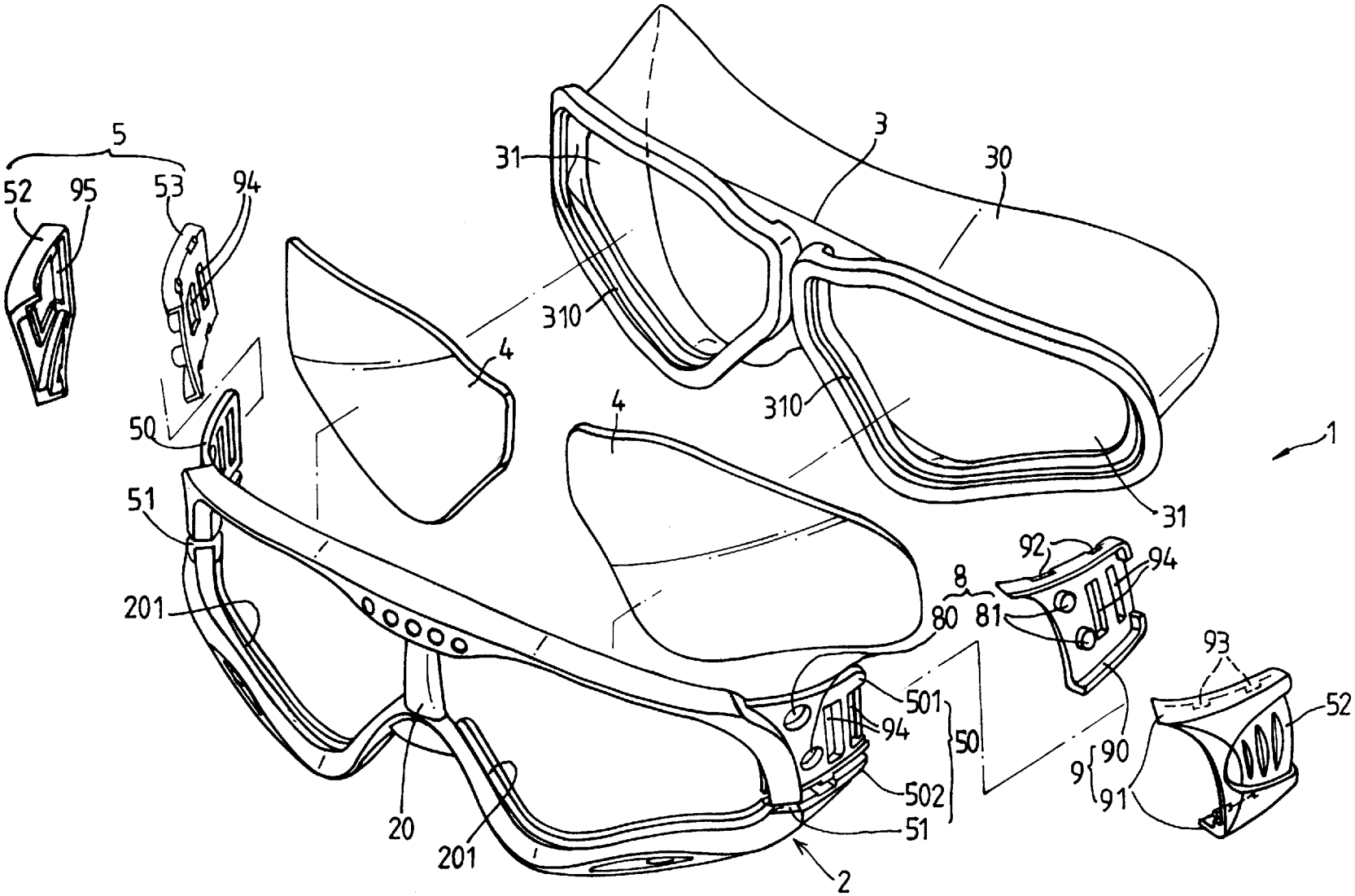
FIG. 1 is an exploded view of this invention of swimming goggles.

As shown in FIG. 1, this invention of swimming goggles comprises: a lens frame main unit 2, a protective pad 3, lenses 4, a compressing device 5 and a headband device 6 (FIG. 5), in which, the lens frame main unit 2 is a frame unit, monobloc formed at the center of the frame unit is a center connector 20 that joins the upper and lower parts of the frame unit, the center connector 20 dividing the frame unit into a left part and a right part and on each of the inside rim of the left and right frame units is an embedding unit 201 that serves to accommodate the lens 4 and the protective pad 3.

The protective pad 3 has a face contact part 30 and a lens accommodating part 31. The face contact part 30 has a larger area, its upper part to be in close contact with the areas above the eyebrows, while its lower part to be in close contact with the areas below the lower eye sockets. The lens accommodating part 31 relates to a formation of a frame opening on the protective pad 3 with an area to match the lens 4. On the rim of the frame is a depressed ring 310 that serves to envelop the rim of the lens 4 before they are jointly accommodated in the embedding groove 201 on the lens frame main unit 2.

On each of two sides of the lens frame main unit 2 is a compressing device 5.

Figure 6:
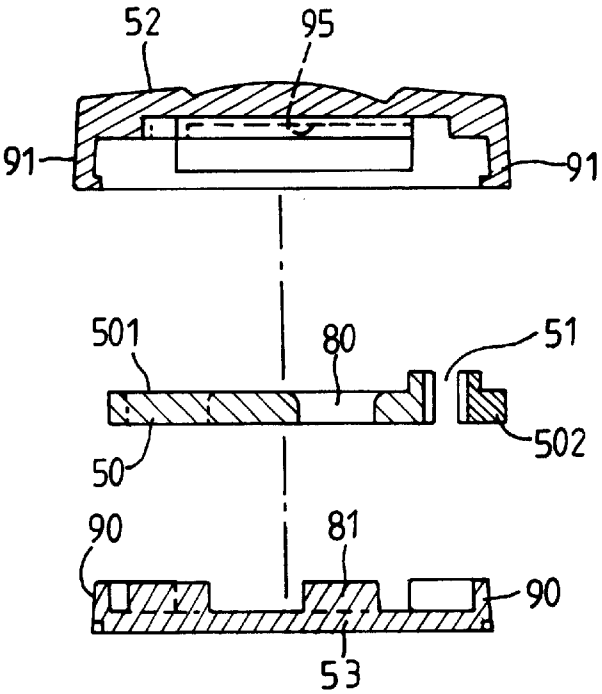
FIG. 6 illustrates the section views of the bottom cover, top cover and connecting plate of this invention of swimming goggles.
Figure 8:
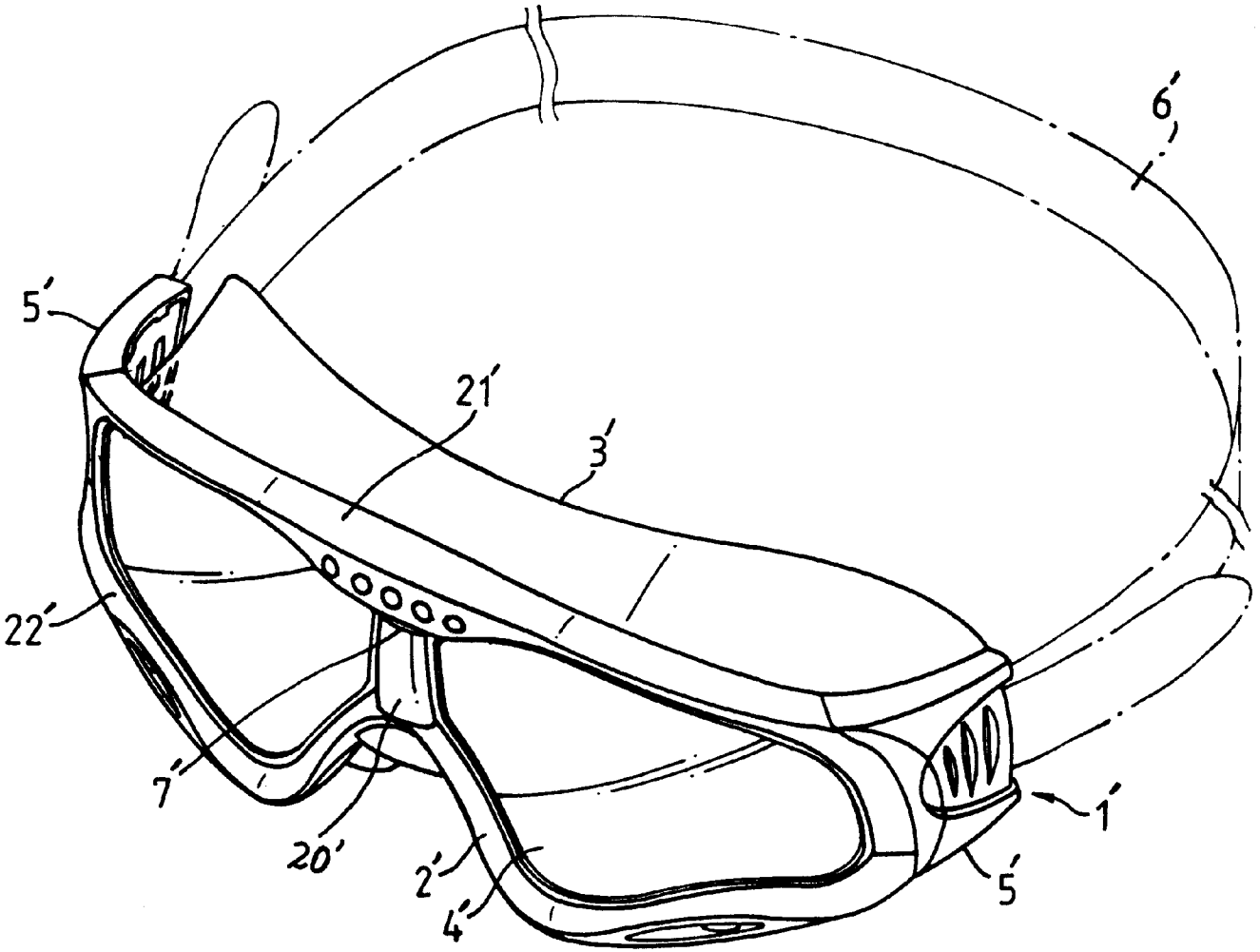
FIG. 8 is a second preferred embodiment of this invention of swimming goggles.

As shown in FIG. 6, the compressing device 5 comprises: a connecting plate 50, an opening 51, a bottom cover 53 and a top cover 52, in which, the connecting plate 50 is an extension of the entire side of the lens frame main unit 2, the opening 51 penetrating the embedding groove 201 and the connecting plate 50, dividing the connecting plate 50 into a large area 501 and a small area 502, the small area 502 having a connecting plate 502 with a better elasticity to facilitate closing of the opening 51. Between the bottom cover 53, the top cover 52 and the connecting plate 50 is a fastening unit 8, the fastening unit 8 has a fastening hole 80 on the connecting plate 501 of the larger area, and a fastening post 81 at an opposite position on the bottom cover 53, to join the bottom cover 53 to the connecting plate 50. The bottom cover 53 and the top cover 52 have a clasp member 9 to close the embedding groove 53 to the opening 51 of the connecting plate 50. The clasp member 9 has a pressing margin 90 on the upper and lower rims of the bottom cover 53 matching the connecting plates 501, 502 of the large and small areas. The vertical distance of the pressing margin 90 is equivalent to the distance to close up the connecting plates 501, 502 of the large and small areas. Between the pressing margin 90 and the compressing margin 91 are depressed grooves 92 and protruded mounds 93 that serve to join the connecting plates 501, 502 of the large and small areas. On the bottom cover 53 and the connecting plate 501 of the large area are inserting holes 94 in which a headband can be inserted. On the inside of the top cover 52 is a stop face 95 that is used to guide the headband and limit it from excessive insertion.

Figure 2:
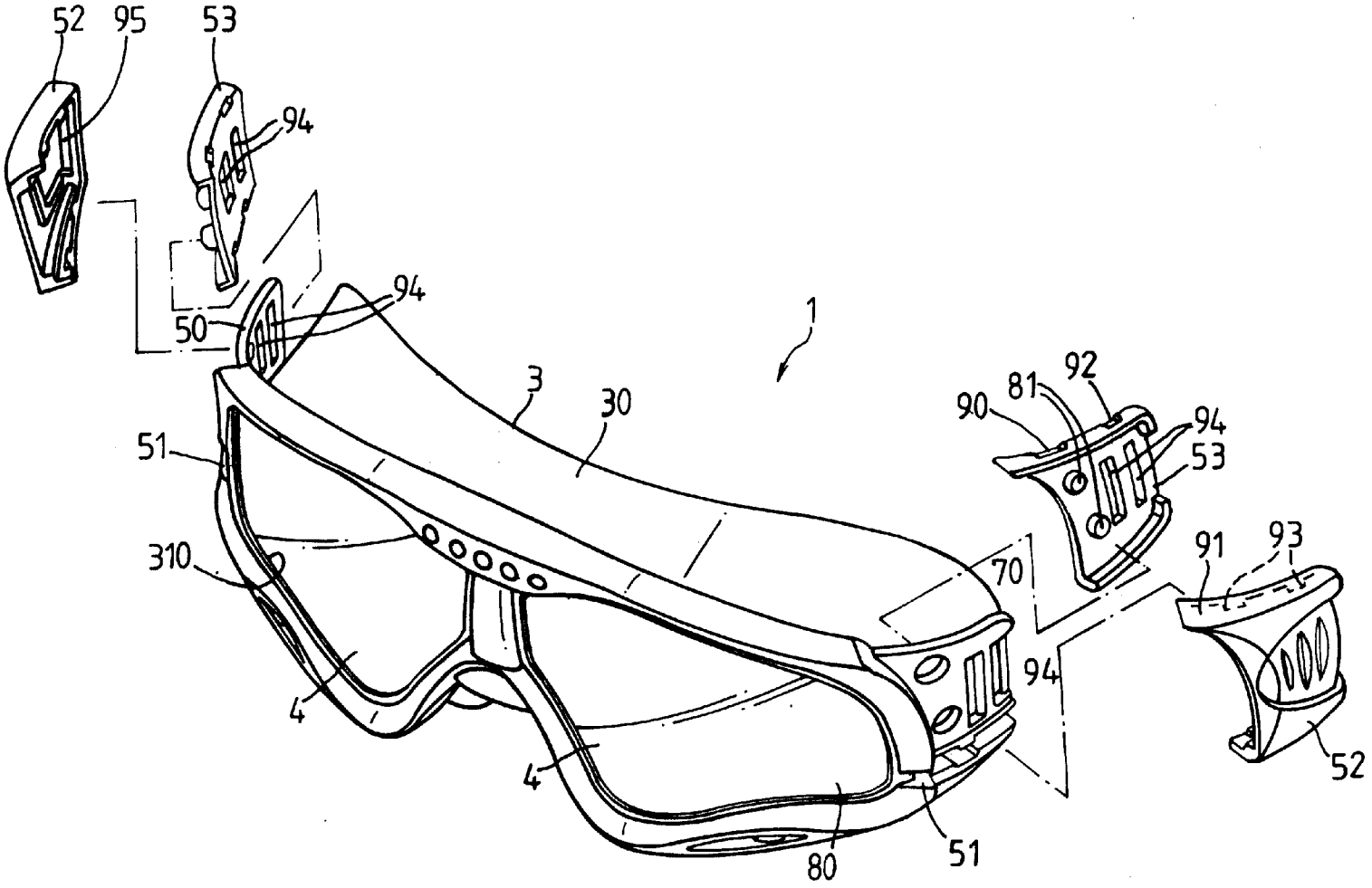
FIGS. 2, 3, 4 and 5 illustrate the gradual steps taken to assemble this invention of swimming goggles.
Figure 3:
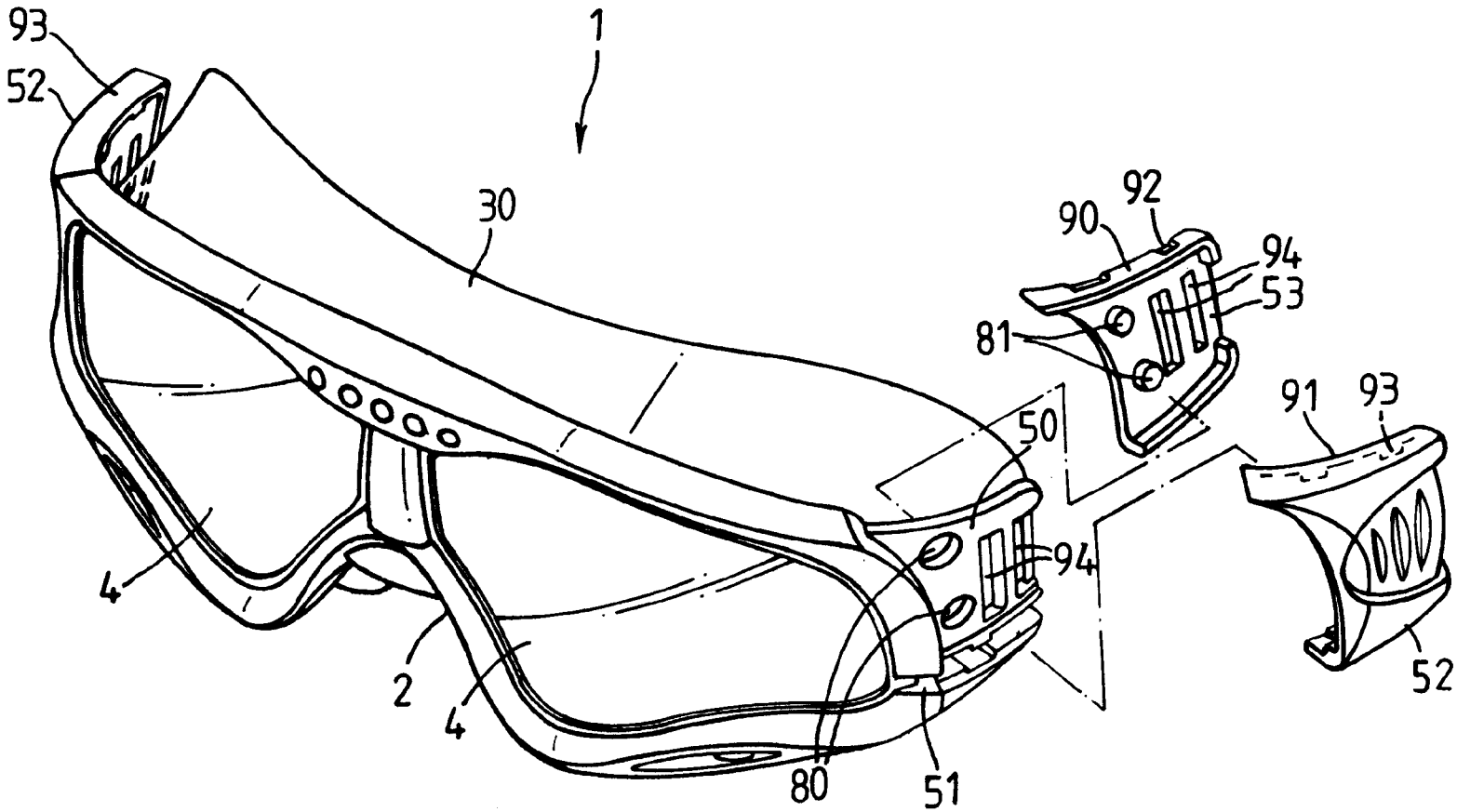
Figure 4:
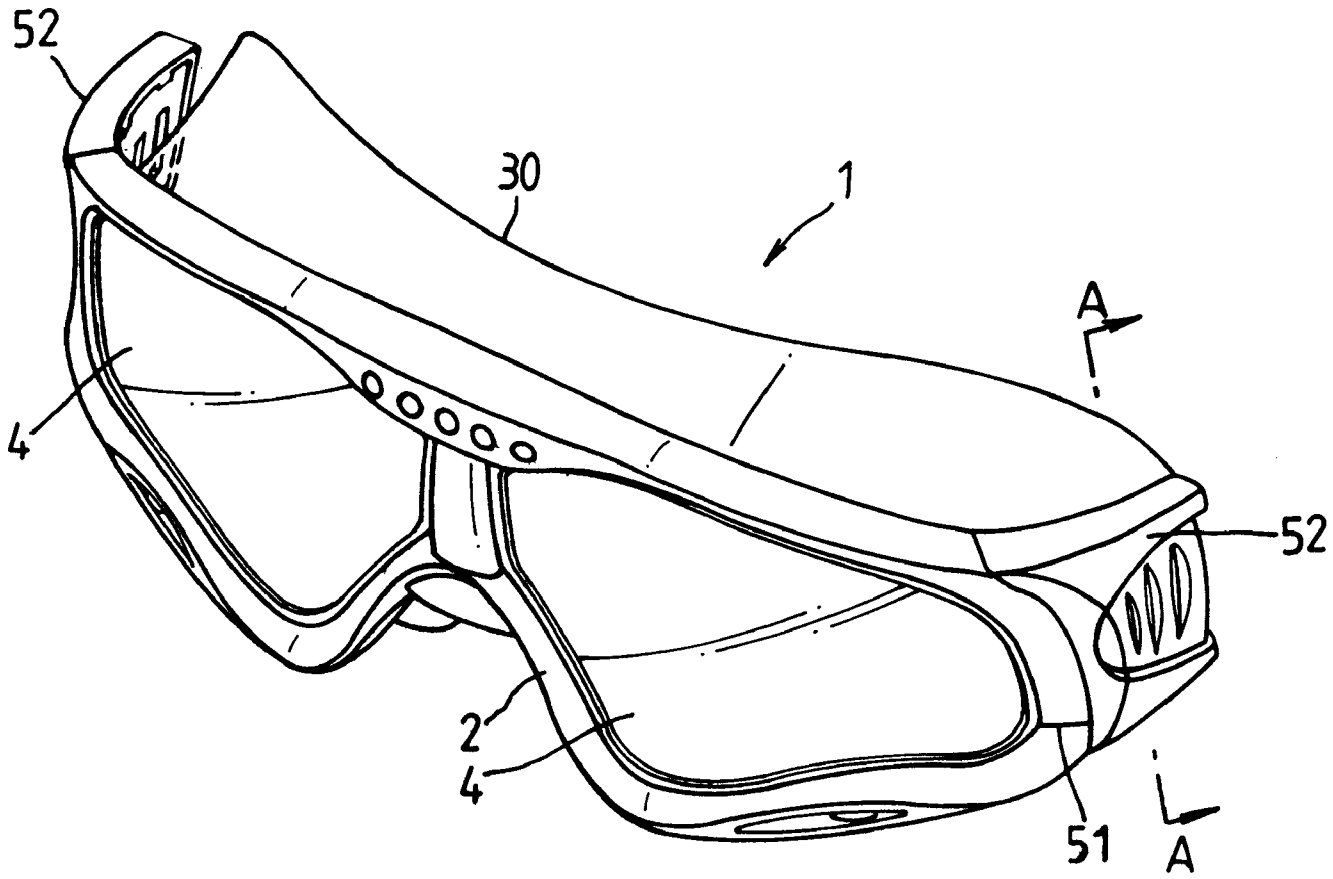
Figure 5:
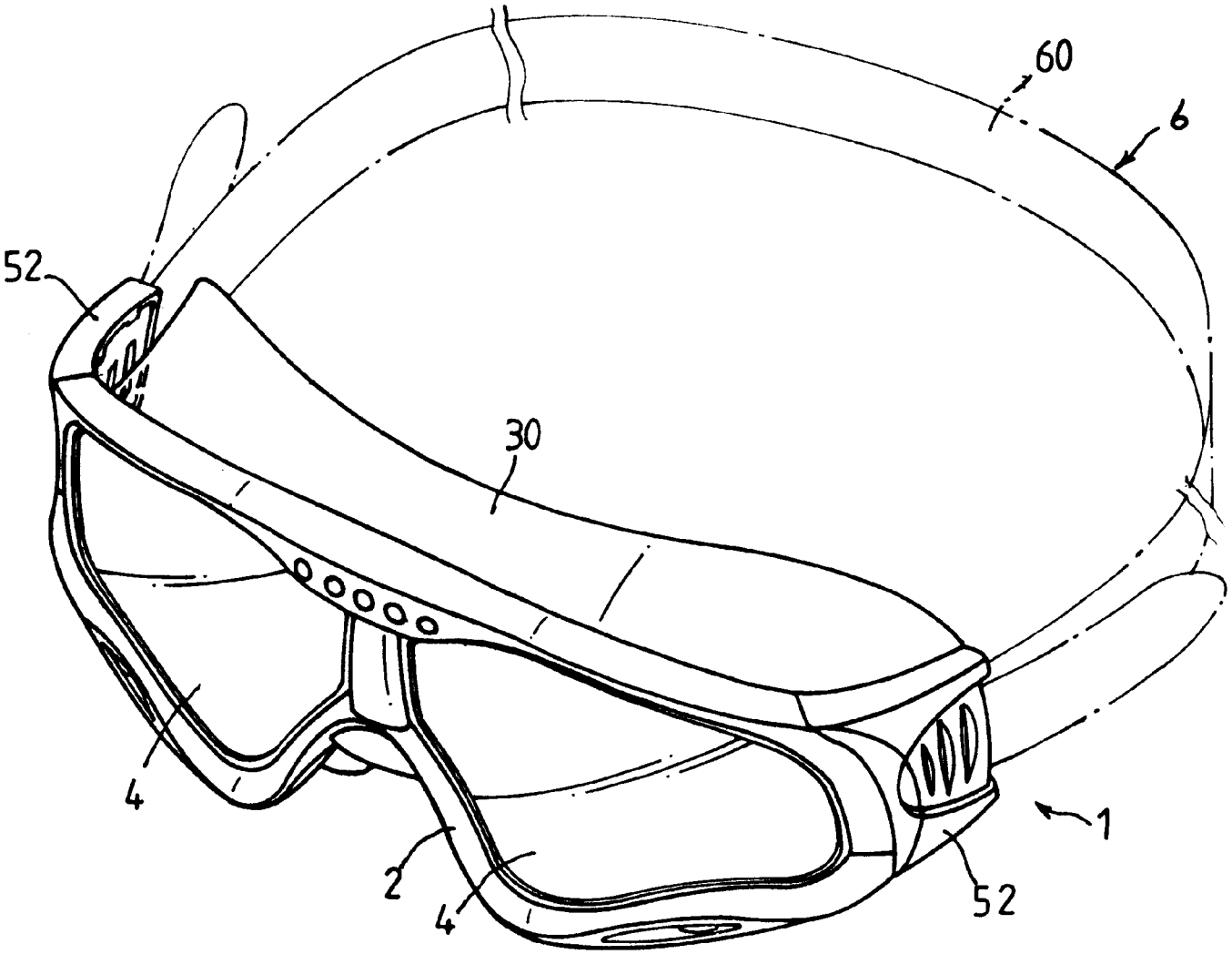
Figure 7:
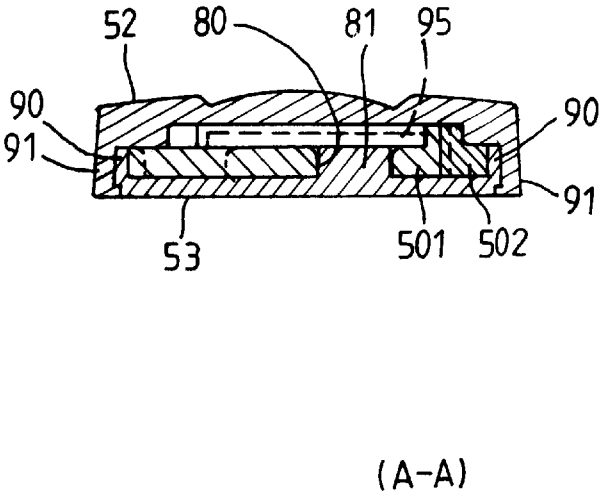
FIG. 7 is a section view taken along the line marked A—A in FIG. 4.

As shown in FIGS. 2 through 5 that illustrate the steps taken to assemble this invention of swimming goggles. First of all, the lens 4 is assembled inside the depressed ring 310 of the lens accommodating part 31 on the protective pad 3, as shown in FIG. 2. Then, the top cover 52 and the bottom cover 53 are assembled on one side, as shown in FIG. 3. Now, referring also to FIG. 7, the top cover 52 and the bottom cover 53 are assembled in the way that, the fastening post 81 of the bottom cover 53 is inserted to the fastening hole 80 of the large area connecting plate 501, so the pressing margin 90 and the compressing margin 91 will compress the small area connecting plate 502 to the large area connecting plate 501, so the depressed grooves 92 and the protruded mounds 93 on the pressing margin 90 and the compressing margin 91 will fasten the opening 51 between the connecting plates 501, 502. Then, the top cover 52 and the bottom cover 53 on the other side are assembled as the above as shown in FIG. 4. Finally, the two ends of the headband 60 of the headband device 6 are respectively inserted through the already assembled top cover 52 and the bottom cover 53. In the inserting process, the headband 60 will be stopped by the stop face 95 (shown in FIG. 7) and guided to go through the inserting holes 94 (shown in FIG. 1) on the bottom cover 53 and the large area connecting plate 501, and then the headband is inserted in position as shown in FIG. 5.

Please refer to the second preferred embodiment of this invention of swimming goggles. In this embodiment, the lens frame main unit 2' of the swimming goggles 1' is composed of an upper frame 21' and a lower frame 22'. At the center, a center connector 20' joins the upper and lower frames 21', 22' of the lens frame main unit 2' as one unit. It can be seen in the drawing that the center connector 20' and the lower frame 22' are formed as one unit, while the upper frame 21' is assembled to the center connector 20' showing a joining face 7'. Other components such as the protective pad 3', the lenses 4', the compressing device 5' and the headband device 6' are the same as in the first preferred embodiment, so it needs no elaboration. In short, the lens frame main unit of this invention of swimming goggles can be one single frame unit as shown in the first preferred embodiment, or the assembly of two frame units as shown in the second preferred embodiment. Both are capable of achieving the objective of this invention.

To conclude, being capable of achieving the objective, this invention of swimming goggles has satisfied the requirement for a new design patent. While the preferred embodiments of this invention have been shown and described, it will be apparent to those skilled in the art that changes and modifications may be made therein without departing from the spirit of the invention, the scope of which is defined by the appended claims.

What is claimed is:

1. A type of swimming goggles, comprising:

a lens frame main unit, comprising a center connector located at its center, embedding grooves located on inside rims of the frame unit, and compressing devices on the sides of the embedding grooves, said compressing device comprising: connecting plates extending from the lens frame main unit, openings penetrating the embedding grooves and connecting plates, and a bottom cover and a top cover that join the connecting plates, wherein between said bottom cover, top cover and connecting plates are fastening units, and the bottom cover and the top cover involve clasp members that serve to close up the embedding grooves and the openings of the connecting plates;

a protective pad, having a face contact part and a lens accommodating part;

lenses, accommodated in the lens accommodating part of the protective pad, the lenses and the lens accommodating part can be jointly accommodated in the embedding groove of the lens frame main unit; and a headband device, located at the sides of the lens frame main unit, comprising at least a headband.

2. The swimming goggles as claimed in claim 1, wherein said connecting plate is an extension from the side of the lens frame main unit, the opening dividing the connecting plate into a large area and a small area, to enable clasping by the clasp member of the bottom cover and the top cover.

3. The swimming goggles as claimed in claim 2, wherein said fastening unit has a fastening hole on the large area connecting plate, and a fastening post at an opposite position on the bottom cover, to join said bottom cover to the connecting plate.

4. The swimming goggles as claimed in claim 3, wherein said clasp member has a pressing margin on bottom cover to oppose the upper and lower rims of the large area and small area connecting plates, the vertical distance of said pressing margin being equivalent to the closing distance of the large area and small area connecting plates, thus, when the fastening post of said bottom cover is joined to the fastening hole of the connecting plate's large area, the pressing margin will be able to compress the small area connecting plate to the large area connecting plate, so the openings of the two can be closed and fastened to achieve fastening effect.

5. The swimming goggles as claimed in claim 4, wherein said top cover has a compressing margin to match the pressing margin of the bottom cover, and between the pressing margin and the compressing margin are depressed grooves and protruded mounds that can be fastened to each other, thereby farther compressing the large area and small area connecting plates to securely fix the bottom cover and the top cover.

6. The swimming goggles as claimed in claim 5, wherein on said bottom cover and large area connecting plate are inserting holes to accommodate the insertion of a headband of the swimming goggles.

7. The swimming goggles as claimed in claim 6, wherein on the inside of said top cover is a stop face to restrict the headband's excessive insertion and to guide the headband.

8. The swimming goggles as claimed in claim 5, wherein the face contact part of said protective pad can be put in close contact with the areas above the eyebrows and below the lower eye sockets.

9. The swimming goggles as claimed in claim 1, wherein said center connector and the lens frame main unit are formed as one unit.

10. The swimming goggles as claimed in claim 1, wherein the bottom side of the lens frame main unit where the center connector is located is formed as a depressed arch along the outline of the ridge of a user's nose.

11. The swimming goggles as claimed in claim 1, wherein said the lens accommodating part of said protective pad is divided into two independent areas on the left and right by the center connector.

12. A type of swimming goggles, comprising:

a lens frame main unit, comprising an upper and lower frames each having an embedding groove, on two sides being compressing device, said compressing device comprising: connecting plates extending from the lens frame main unit, openings penetrating the embedding groove and the connecting plate, and a bottom cover and a top cover that serve to join the connecting plates, wherein between said bottom cover, top cover and connecting plates are fastening units, and on the bottom cover and the top cover being a clasp member to close and engage the embedding grooves with the openings of the connecting plates;

a connecting part, located at the center of the lens frame main unit, serving to join the upper and lower rims of the lens frame main unit;

a protective pad, having a face contact part and a lens accommodating part;

lenses, accommodated in the lens accommodating part of the protective pad, the lenses and the lens accommodating part can be jointly accommodated in the embedding groove of the lens frame main unit; and a headband device, located at the sides of the lens frame main unit, comprising at least a headband.

13. The swimming goggles as claimed in claim 12, wherein the bottom rim of the lens frame main unit where the center connector is located is formed as a depressed arch to suit the outline of the ridge of a user's nose.

14. The swimming goggles as claimed in claim 13, wherein the lens accommodating part of the protective pad is divided into two independent areas in the left and right by the center connector.

15. The swimming goggles as claimed in claim 14, wherein said connecting plate is an extension from the side of the lens frame main unit, the opening dividing the connecting plate into a large area and a small area, to enable clasping by the clasp member of the bottom cover and the top cover.

16. The swimming goggles as claimed in claim 15, wherein said fastening unit has a fastening hole on the large area connecting plate, and a fastening post at an opposite position on the bottom cover, to join said bottom cover to the connecting plate.

17. The swimming goggles as claimed in claim 16, wherein said clasp member has a pressing margin on bottom cover to oppose the upper and lower rims of the large area and small area connecting plates, the vertical distance of said pressing margin being equivalent to the closing distance of the large area and small area connecting plates, and between the pressing margin and the compressing margin are depressed grooves and protruded mounds that can be fastened to each other, thus, when the fastening post of said bottom cover is joined to the fastening hole of the connecting plate's large area, the pressing margin will be able to compress the small area connecting plate to the large area connecting plate, so the openings of the two can be closed and fastened to achieve fastening effect.

18. The swimming goggles as claimed in claim 17, wherein on said bottom cover and large area connecting plate are inserting holes to accommodate the insertion of a headband of the swimming goggles.

19. The swimming goggles as claimed in claim 18, wherein on the inside of said top cover is a stop face to restrict the headband's excessive insertion and to guide the headband.

20. The swimming goggles as claimed in claim 19, wherein the face contact part of said protective pad can be put in close contact with the areas above the eyebrows and below the lower eye sockets.

* * * * *